United States Patent [19]

Barnes

[11] Patent Number: 4,750,698

[45] Date of Patent: Jun. 14, 1988

[54] SCANNER HOOK ADAPTOR

[76] Inventor: Richard D. Barnes, 2156 E. Chester Ridge Dr., High Point, N.C. 27260

[21] Appl. No.: 109,756

[22] Filed: Oct. 19, 1987

[51] Int. Cl.[4] ..... E04G 3/00

[52] U.S. Cl. ..... 248/220.4; 211/59.1

[58] Field of Search ..... 248/220.3, 220.4, 221.1, 248/221.2; 211/59.1, 57.1; 40/16, 16.2, 16.4, 16.6, 19.5

[56] References Cited

U.S. PATENT DOCUMENTS

| | | | |
|---|---|---|---|
| 3,452,954 | 7/1969 | Lucietto | 211/59.1 X |
| 3,645,485 | 2/1972 | Gold | 248/221.1 |
| 4,286,764 | 9/1981 | Pfeifer | 248/220.3 |
| 4,289,242 | 9/1981 | Kenyon | 211/59.1 X |
| 4,394,909 | 7/1983 | Valiulis | 248/220.3 X |
| 4,520,978 | 6/1985 | Taub | 211/59.1 X |
| 4,662,592 | 5/1987 | Garfinkle | 248/221.1 |

*Primary Examiner*—J. Franklin Foss

[57] ABSTRACT

A scanner hook adaptor is molded from a durable plastic and includes hook gripping means and a hook support whereby a conventional merchandise hook saddle can be modified to include an upper information hook with a reader tag.

4 Claims, 1 Drawing Sheet

SCANNER HOOK ADAPTOR

BACKGROUND OF THE INVENTION

1. Field Of The Invention

The present invention relates to display hooks as used in retail stores which are affixed to perforated panels or boards and particularly relates to merchandise display hooks having reader tags thereon.

2. Description Of The Prior Art

And Objectives Of The Invention

In recent years, retail stores and other businesses have increasingly employed display hooks which are releasably attached to perforated panels or boards due to the high visibility of the merchandise and easy access by customers or the like. Various types of perforated boards employing merchandise hooks are easily stocked, inventoried and customers enjoy the easy visibility and access of products suspended therefrom. With the increase of bar code marking pricing of merchandise packages and such eliminating the need for cashiers to actually read prices on merchandise, products displayed or suspended on merchandise hooks have consequently not required the pricing placed on individual packages but have required information such as price, weights, count and other data to be displayed nearby. For example, many types of "information hooks" have developed whereby shoppers can obtain such product information from a reader tag positioned above and generally forward of the merchandise which is generally suspended below on the merchandise hook. Conventional information hooks to date have either been separate and apart from the merchandise hook requiring a different "saddle" for a single hook or have been formed as an integral part of the merchandise hook by complex bending of the hook wire which may be, for example, 3/16 to ¼ inch diameter and formed from steel.

Due to cost, convenience and handling difficulties, such prior art devices have not always been satisfactory for specific purposes and therefore the present invention has developed. Thus, one of its objectives is to provide a conveniently located information hook which can be easily placed proximate to conventional merchandise hooks while utilizing a minimum of space on the perforated board.

It is still another objective of the present invention to provide a scanner hook adaptor which will fit on certain conventional scanner hook saddles to support the information hook.

Another objective of the present invention is to provide a scanner hook adaptor which can be molded as a integral unit and to which an information hook can be easily and securely affixed.

It is another objective of the present invention to provide a scanner hook adaptor which can be quickly mounted to a conventional scanner hook saddle by a relatively unskilled worker.

It is another objective of the present invention to provide a scanner hook adaptor which is relatively low in cost and yet which will be durable over many years of use.

Various other objectives and advantages of the present invention will become apparent to those skilled in the art as a more detailed explanation of the invention is presented below.

SUMMARY OF THE INVENTION

The scanner hook adaptor of the present invention is formed from a durable plastic which is molded and has a planer back for positioning against a smooth perforated wall board. A hook support is attached to the front surface of the planer back for containing an information hook and positioned along the bottom of the adaptor is a base having a hook gripping means.

DESCRIPTION OF THE PREFERRED EMBODIMENT

Figures 1, 2:
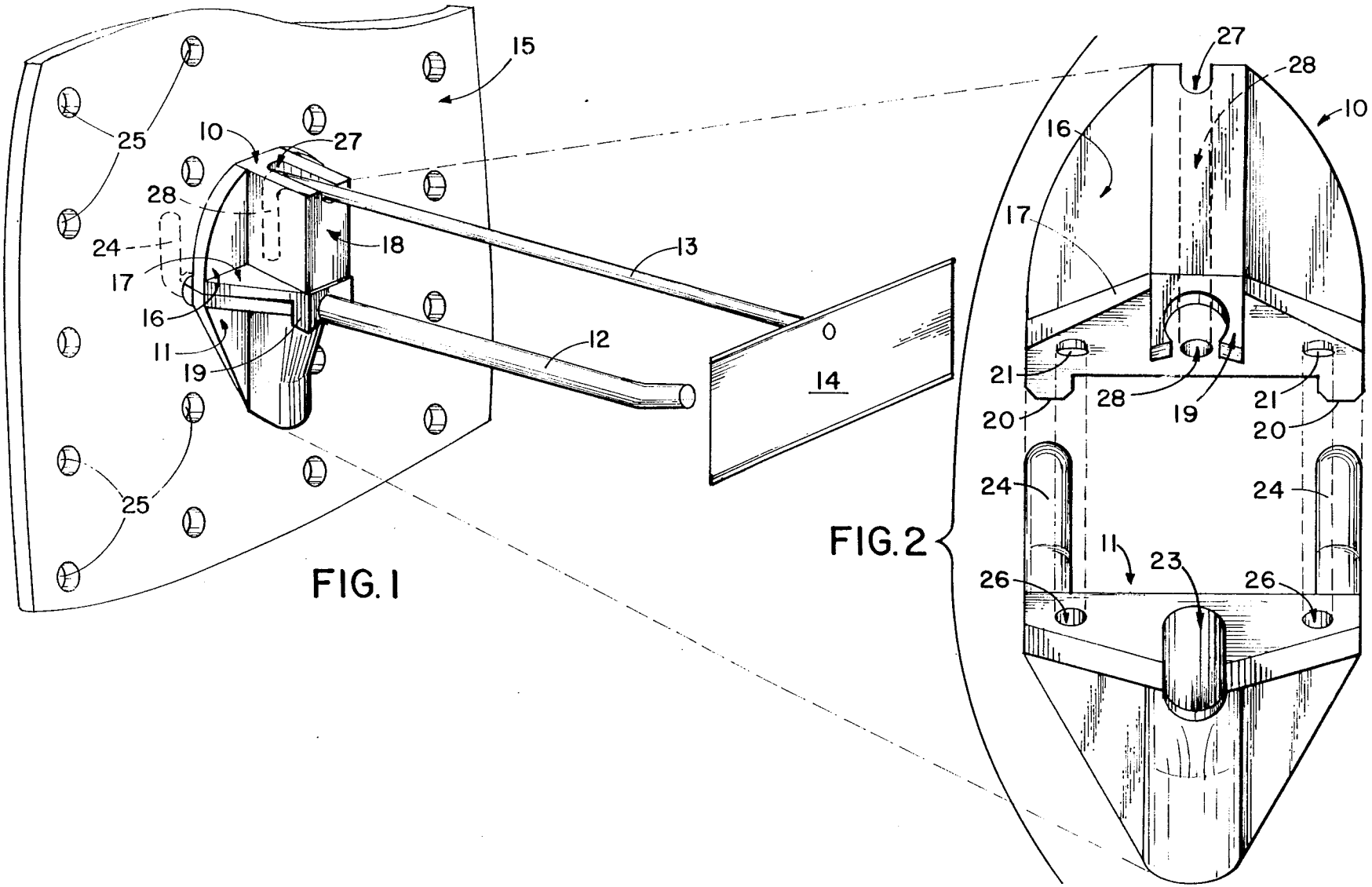
FIG. 1 demonstrates the scanner hook adaptor of the invention mounted on a fragmented perforated board and positioned on a conventional scanner hook saddle.
FIG. 2 demonstrates a front view of the scanner hook adaptor and scanner hook saddle in exploded fashion with the front opened approximately 30° to better show the components thereof.

The preferred form of the scanner hook adaptor is shown in FIG. 2 whereby the substantially flat base has a pair of rearwardly extending stabilizers thereon and has a merchandise hook gripper extending slightly below. The invention in its preferred form is integrally constructed by injection molding from a suitable durable plastic and includes a pair of studs which fit into apertures along the top of the scanner hook saddle.

DETAILED DESCRIPTION OF THE DRAWINGS AND OPERATION OF THE INVENTION

For a better understanding of the invention and its operation, a typical perforated board 15 is shown in FIG. 1 having a plurality of evenly spaced apertures 25 therein. Perforated board 15 may be of masonite, particle board, plywood or various other compositions, construction or laminates. Board 15 can then be attached to walls, shelves or the like in retail stores, offices, warehouses and other locations as desired by the user.

Merchandise hook 12 as seen in FIG. 1 may consist of a 3/16 inch diameter plated steel wire which is formed to hold merchandise packets or the like in a convenient and easily visible posture. Hook 12 is formed to penetrate into planer hook channel 23 as shown in FIG. 2. Scanner hook saddle 11 is affixed to perforated board 15 by saddle fingers 24 as shown in FIG. 2 and by dotted lines in FIG. 1. Scanner hook saddle 11 is well known in the display trade and has achieved widespread use.

Scanner hook adaptor 10 as shown in FIG. 2 includes base 17 which, along its bottom side is substantially flat except for two (2) saddle studs 21 as shown in FIG. 2 which extend approximately 1/16 inch below the bottom surface of base 17. Saddle studs 21 are aligned with saddle apertures 26 as also shown in FIG. 2.

Hook gripping means 19 comprises an inverted U-shaped opening which is sized to "snap" over merchandise hook 12 and firmly grip the same. Gripping means 19 extends below base 17 and is joined to hook support 18. Stabilizers 20 extend rearwardly from base 17 and fit into the same perforated board openings as do saddle fingers 24 to assist in preventing lateral movement of adaptor 10 during use. Information hook support 18 comprises a substantially rectangularly shaped container having a horizontal support channel 27 which communicates with vertical channel 28 as shown in FIG. 2. As also shown in FIG. 1, top information hook 13 can be placed in hook support 18 and reader tab 14 can be placed on information hook 13 to identify and provide data for merchandise as may be suspended from merchandise hook 12. Back 16 of scanner hook adaptor 10 has a smooth rear surface for flush engagement with the front of perforated board 15 as seen in FIG. 1. Thus, with hook adaptor 10 in place, reader tab 14 can be seen by shoppers without fear of dislodging hook adaptor 10 or by inadverent bumping as, for example, by the removal of products from hook 12.

The illustrations and examples provided herein are for explanatory purposes and are not intended to limit the scope of the appended claims.

I claim:

1. A scanner hook adaptor comprising: a substantially planer back, a base, said back attached to said base, a hook support, said hook support attached to said base, said hook support including a substantially vertical channel for receiving a hook, hook gripping means, said gripping means attached to said base and extending below said base, and including a saddle stud, said stud attached to said base.

2. A scanner hook adaptor as claimed in claim 1 wherein said hook gripping means is attached to said hook support.

3. A scanner hook adaptor as claimed in claim 1 and including a stabilizer, said stabilizer attached to said base.

4. A scanner hook adaptor comprising: a substantially planar back, a base, said back attached to said base, a hook support, said support attached to said back and to said base, said hook support including a substantially vertical channel for receiving a hook, hook gripping means, said gripping means affixed to said support and extending below said base, a pair of stabilizers, said stabilizers attached to said back and extending rearwardly therefrom, a pair of saddle studs, said saddle studs positioned on the bottom of said base and extending downwardly therefrom whereby the scanner hook adaptor will releasably mount on a scanner hook saddle.

* * * * *